US007430787B2

(12) United States Patent
Loetscher

(10) Patent No.: US 7,430,787 B2
(45) Date of Patent: Oct. 7, 2008

(54) LINK ELEMENT INCLUDING A CASING FORMED OF A PLATE AND A BACK PLATE

(75) Inventor: Philippe Loetscher, Evilard (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 11/463,686

(22) Filed: Aug. 10, 2006

(65) Prior Publication Data

US 2007/0143970 A1 Jun. 28, 2007

(30) Foreign Application Priority Data

Dec. 23, 2005 (EP) ..... 05112902

(51) Int. Cl.
*A44C 5/14* (2006.01)

(52) U.S. Cl. ..... 24/265 B; 24/265 WS

(58) Field of Classification Search ..... 24/265 B, 24/265 WS; 224/164, 177; 368/281, 282
See application file for complete search history.

(56) References Cited

U.S. PATENT DOCUMENTS

| | | | | |
|---|---|---|---|---|
| 2,901,806 | A * | 9/1959 | Henshel | 24/265 R |
| 3,685,107 | A * | 8/1972 | Epiard | 24/601.7 |
| 3,908,423 | A | 9/1975 | Lou et al. | |
| 5,483,505 | A | 1/1996 | Cartier | |
| 6,014,793 | A | 1/2000 | Howald | |
| 2001/0016971 | A1 | 8/2001 | Guyard | |
| 2005/0235464 | A1 | 10/2005 | Sima | |

FOREIGN PATENT DOCUMENTS

| | | | |
|---|---|---|---|
| CH | 689 369 | A5 | 3/1999 |
| EP | 0 397 548 | A1 | 11/1990 |
| EP | 0 494 584 | A1 | 7/1992 |
| WO | 84/00285 | | 2/1984 |

OTHER PUBLICATIONS

Austrian Search Report issued in corresponding Singapore application No. 200604870-6.
European Search Report issued in corresponding application No. EP 05 11 2902 completed Mar. 7, 2006.

* cited by examiner

*Primary Examiner*—James R Brittain
(74) *Attorney, Agent, or Firm*—Griffin & Szipl, P.C.

(57) ABSTRACT

The link element (12) includes a strand (14), which extends longitudinally in a horizontal plane, and a front end which (22) includes a device for attachment to a watch (10). The attachment device includes a casing (24), which is secured to the front end (22) of the strand (14), and two coaxial securing pins (26) of transverse axis (A) which are received in two associated lateral housings (28) of the casing (24). A free end of each pin (26) is pivotally received about the transverse axis (A) in one of the two opposite orifices of the watch (10). The casing (24) includes a bottom plate (32) and a top back plate (34), The front end (22) of the strand (14) includes a holding pin (44), which is fitted vertically into a opening (46) of the bottom plate (32). The top back plate (34) is secured to the bottom plate (32) trapping the front end (22) of the strand (14) such that the casing (24) is secured to the strand (14).

16 Claims, 5 Drawing Sheets

LINK ELEMENT INCLUDING A CASING FORMED OF A PLATE AND A BACK PLATE

This application claims priority from European Patent Application No. 05112902.1 filed Dec. 23, 2005, the entire disclosure of which is incorporated herein by reference.

FIELD OF THE INVENTION

The invention concerns a link element, particularly of a wristband or bracelet, including one strand, one front end of which includes a device for attachment to a watch.

The invention concerns more particularly a link element, particularly of a bracelet, including one strand which extends longitudinally in a horizontal plane and a front end of which includes a device for attachment to a watch, the attachment device including:

a casing which is fixed to the front end of the strand;

two coaxial securing pins of transverse axis which are received in two associated lateral housings of the casing, one free end of each pin being pivotally received about the transverse axis in one or the two opposite orifices of the watch.

BACKGROUND OF THE INVENTION

Bracelet link elements of this type are already known. The casing is generally made in a single piece, then it is secured to the strand.

In order to secure the casing to the strand, the front end of the strand is generally bent in order to form a loop into which the casing is introduced.

CH Patent No. 689,369 also proposes arranging the casing at the front end of the strand then covering the strand and the casing with a common envelope so that the casing is assembled with the strand. The envelope thus secures the casing to the strand.

All of these methods of securing the casing require detailed and expensive operations.

SUMMARY OF THE INVENTION

The invention proposes to overcome this problem by proposing a link element of the previously described type, characterized in that the casing includes a bottom plate and a top back plate, and in that the front end of the strand includes a holding pin which is fitted vertically into a opening or recess in the bottom plate, the top back plate being secured to the bottom plate enclosing the front end of the strand such that the casing is secured to the strand.

According to other features of the invention:

the back plate is secured to the plate by complementary shapes nest fitted into each other;

the back plate is secured to the plate by bonding;

the back plate is secured to the plate by screws;

the plate includes first nested fitting means which cooperate with second complementary nested fitting means carried by the back plate in order to block horizontal movements by the plate in relation to the back plate;

each lateral housing of the casing is formed partly downwards in the plate and partly upwards in the back plate;

each pin is telescopically mounted axially in an associated socket, and each socket includes resilient means for snap fitting inside the associated lateral housing of the casing;

each lateral housing of the casing includes a raised part which is radially received in an annular radial groove of the socket so as to immobilize the socket axially;

the lateral housings are contiguous and each pin is telescopically mounted axially in an end section of a single socket;

the bottom plate includes a bottom edge which extends forwards horizontally so as to match the contour of the watch to limit the pivoting of the front end of the link element in relation to the watch;

the strand is a flexible core which is made in a single piece;

the strand is covered with a top envelope which extends above the top back plate of the casing;

one front end section of the top envelope is folded over downwards so as to extend at least as far as the bottom edge of the bottom plate;

the bottom edge includes a recess which allows a front tongue end of the top envelope to be turned over in order to be fixed under the bottom face of the strand;

the envelope is made of leather;

the envelope is made of a natural or synthetic fabric.

BRIEF DESCRIPTION OF THE DRAWINGS

Other features and advantages will appear more clearly upon reading the following detailed description for the comprehension of which reference will be made to the annexed drawings, in which.

DETAILED DESCRIPTION OF THE ILLUSTRATIVE EMBODIMENTS

Hereinafter, a longitudinal, vertical and transverse orientation, indicated by the trihedral "L, V, T" of FIG. 1, will be adopted in a non-limiting manner.

In the following description, identical, similar or like elements will be designated by identical references.

Figure 1:
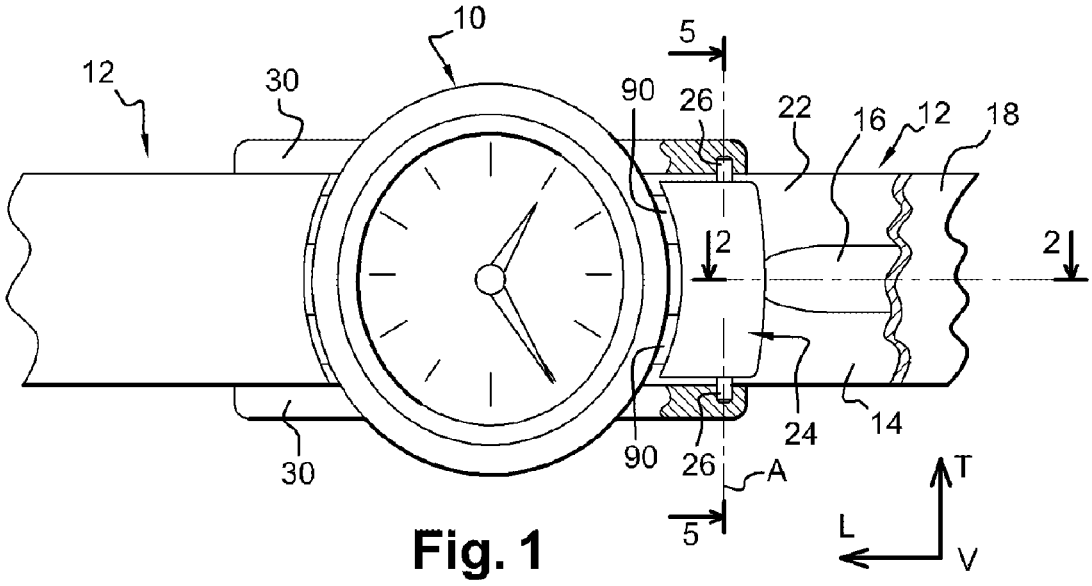
FIG. 1 is a top torn away view which shows a watch fitted with a bracelet including two link elements which are made in accordance with the teaching of the invention and which are enveloped in a material such as leather, the envelope is torn away so that the device fixing a link element to the watch can be seen.

FIG. 1 shows a watch 10 which is fitted with a bracelet including two link elements 12 which extend longitudinally on either side of watch 10.

The following description is made with reference to the link element 12 which is shown on the right of FIG. 1. However, since the two link elements 12 have a similar structure here, the description is also applicable to the other link element 12.

Link element 12 includes a flat strand 14 which extends longitudinally in a horizontal plane. Strand 14 is made in a single piece with a flexible material such as plastic. In a non-limiting manner, strand 14 includes a central longitudinal rib 16 which projects vertically upwards in relation to the top surface of strand 14.

The front longitudinal end of link element 12 is located on the side of the case of watch 10 and the back longitudinal end of link element 12 is located on the opposite side to the watch.

Figure 2:
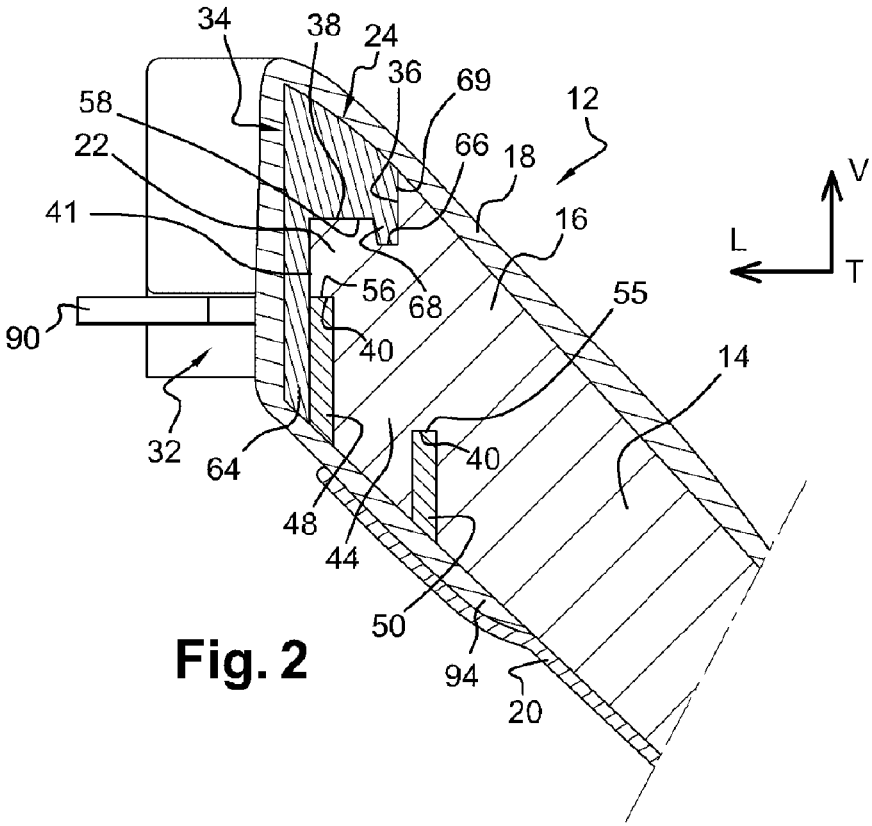
FIG. 2 is a longitudinal cross-section along the cross-sectional plane 2-2 of F*igure* 1.

In a known manner, as shown in FIG. 2, strand 14 forms a flexible core which is covered with top envelope 18 and a bottom envelope 20 made in a flexible material such as leather, fabric, plastic, neoprene, or any other material suitable for making a watch bracelet. Of course, top envelope 18 can be made of a different material from bottom envelope 20, and each envelope can be formed of several parts made of different materials.

Advantageously, the top envelope 18 and bottom envelope 20 are sewn to each other.

As shown in FIG. 1, the front end 22 of strand 14 includes a device for attachment to watch 10. The attachment device includes a casing 24 which is secured to the front end 22 of strand 14 and it includes two coaxial securing pins 26 of transverse axis "A".

Pins 26 are received in associated opposite lateral housings 28 of casing 24. Each lateral housing 28 opens into one of the two opposite longitudinal vertical lateral walls of casing 24.

On free end of each pin 26 projects transversely in relation to the associated lateral wall of casing 24.

The front end 22 of strand 14 is to be inserted between two lateral horns 30 of watch 10 such that the free ends of pins 2 are received in two opposite orifices of watch 10, which are carried by horns 30 of watch 10.

Since pins 26 are coaxial, strand 14 is thus pivotally mounted about transverse axis "A" in relation to watch 10.

Figure 3A:
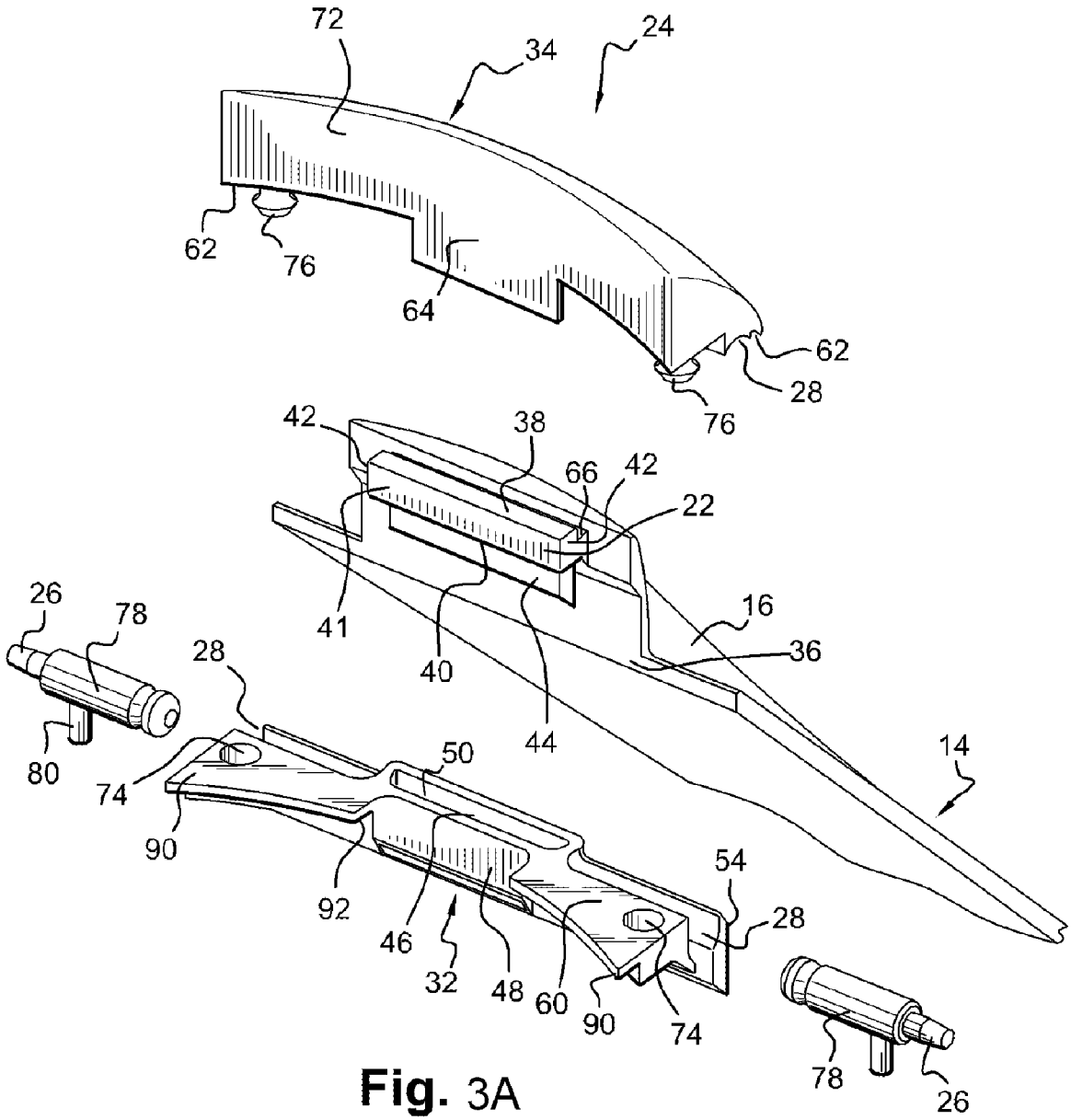
FIG. 3A is an exploded perspective view which shows a link element of FIG. 1 without the envelope.
Figure 4:
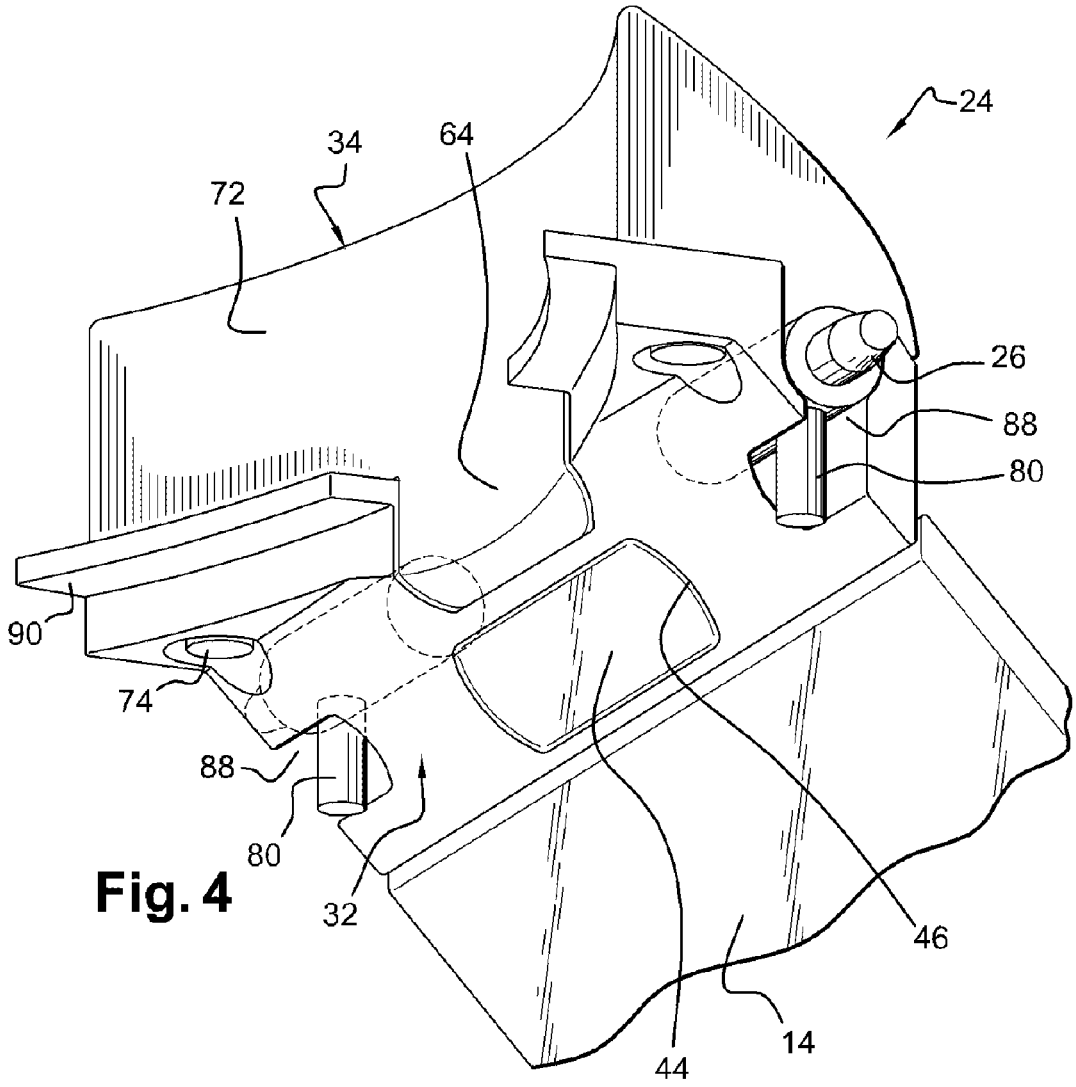
FIG. 4 is a larger scale detailed view which shows the casing mounted on the strand of the link element of FIG. 1 without the envelope.

According to the teaching of the invention, as shown in FIG. 3A casing 24 includes a bottom plate 32 and a top back plate 34 which are secured to each other trapping front end 22 of strand 14 such that casing 24 is secured to strand 14, as shown in FIG. 4.

Rib 16 of strand 14 is delimited longitudinally forwards by a front vertical shoulder face 36. The front end of strand 22 is shaped here like a paving stone, which projects forwards longitudinally in relation to the shoulder face 36. The front end 22 of strand 14 includes a top horizontal surface 38, a bottom horizontal surface 40, a vertical front surface 41 and two lateral vertical surfaces 42.

The front end of strand 22 includes a holding pin 44 which extends vertically downwards and projects in relation to the bottom surface 40 thus forming a first transverse bottom groove which is delimited longitudinally by the holding pin 44 and by the shoulder face 36.

Holding pin 44 is to be vertically fitted into a opening 46 of complementary shape carried by plate 32. Opening 46 is longitudinally delimited by a front vertical wall 48 and by a back vertical wall 50 of plate 32, and it is delimited transversely by lateral walls 52.

Bottom plate 32 also includes a vertical support surface 54 which is arranged at the back of plate 32. Vertical support surface 54 of plate 32 will be pressed against the shoulder face 36 of front end 22 of strand 14.

When plate 32 is mounted on strand 14, back wall 50 of plate 32 is received in the bottom groove such that the top edge 55 of back wall 50 is abutting against the bottom surface 40 of front end 22 forming the bottom of the groove.

Figure 5:
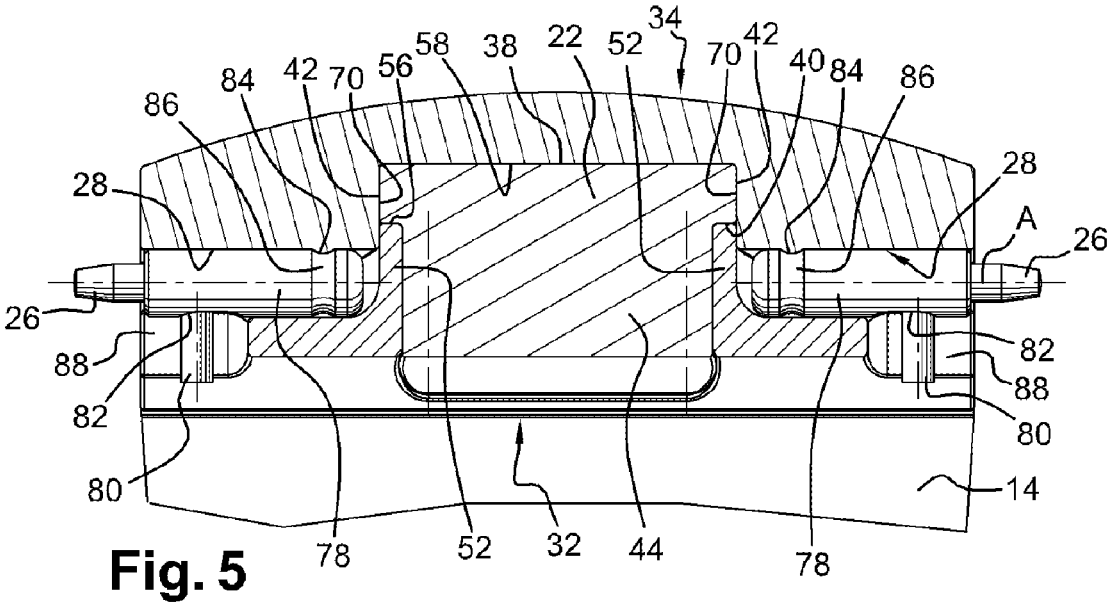
FIG. 5 is a transverse cross-section along the cross-sectional plane 5-5 of FIG. 1.

Front wall 48 and lateral walls 52 of plate 32 include a top edge 56 in the shape of a "U" open backwards which will abut against the bottom surface 40 of front end 22. As shown in FIGS. 2 and 5, an external face of the front 48 and lateral 52 walls are arranged in the extension of front 41 and lateral 42 surfaces of the front end 22 of strand 14.

The top back plate 34 includes a bottom support surface 58 which is arranged at the back of back plate 34. The bottom support surface 58 will abut on the top surface 38 of front end 22 of strand 14, opposite holding pin 44.

The front end 22 of strand 14 is thus trapped between plate 32 and the bottom support surface 58 of back plate 34. The longitudinal movements of strand 14 in relation to casing 24 are thus blocked forwards by the contact of pin 44 by front wall 48 of plate 32 and backwards by the back wall 50 of plate 32. The vertical movements of the strands in relation to casing 24 are blocked upwards by back plate 34 and downwards by plate 32. Finally, the transverse movements of strand 14 in relation to casing 24 are blocked transversely by lateral walls 52.

The plate 32 also includes a top contact surface 60 which will be in direct contact with a bottom contact surface 62 carried by back plate 34. The contact surfaces 60', 62 are arranged at the front of plate 32 and back plate 34.

Contact surfaces 60, 62 also extend transversely on either side of front end 22 of strand 14. Contact surfaces 60, 62 thus form a "U" open longitudinally backwards, which continuously frames the front end 22 of strand 14. This configuration ensures that casing 24 is rigidly secured to front end 22 of strand 14.

Back plate 34 includes here a front lug 64 which extends vertically downwards and which will be arranged adjacent to the front surface 41 of front end 22 of strand 14 when casing 24 is secured to strand 14, as shown in FIG. 2. Lug 54 extends downwards here adjacent to the front surface of front wall 48 of back plate 34.

Front wall 48 of plate 32 is thus gripped longitudinally between lug 64 and holding pin 44 so as to reinforce the rigidity of the attachment of back plate 34 to plate 32.

Moreover, the top surface 38 of the front end of strand 22 includes a transverse groove 66 into which a projecting portion 68 of support surface 58 of back plate 34 will be nest fitted vertically downwards. This nest fit totally immobilizes back plate 34 in relation to strand 14. In particular, the back vertical face 69 of back plate 34 is thus held in contact against the shoulder face 36 of strand 14.

Finally, back plate 34 includes opposite lateral walls 70, which extend downwards from the bottom support face. Lateral walls 70 frame transversely the front end 22 of strand 14, adjacent to the lateral surfaces 42 of front end 22. Lateral walls 70 are also adjacent to a top portion of lateral walls 52 of opening 46 so as to immobi1ize back plate transversely in relation to plate 32.

Thus, lug 64, lateral walls 70 and projecting portion 68 immobilize back plate 34 horizontally in all directions in relation to plate 32.

Plate 32 is made here of a metallic material such as steel, whereas back plate 34 is made of a plastic material.

Of course, according to variants (not shown), plate 32 and back plate 34 could be made of other materials. They could also both be made of the same material.

Advantageously, the front transverse vertical face 72 of casing 24 which is opposite to the case of watch 10 is shaped such that it matches the shape of the case of watch 10.

Back plate 34 is secured here to plate 32 by the resilient snap fit of complementary shapes. Thus, orifices 74, two in number here, are reserved in the top contact surface 60 of plate 32. Hooks 76 that can deform resiliently in flexion extend vertically downwards from the bottom contact surface 62 of back plate 34 coinciding with orifices 74 of plate 32.

As shown in FIG. 4, hooks 76 are resiliently fitted into orifices 74 so as to secure back plate 34 to plate 32 pressing contact surfaces 60, 62 against each other and pinching the front end 22 of strand 14.

Moreover, the top surface 38 of the front end of strand 22 includes a transverse groove 66 into which a projecting portion 68 of support surface 58 of back plate 34 will be nest fitted vertically downwards. This nest fit totally immobilizes back plate 34 in relation to strand 14. In particular, the back vertical face 69 of back plate 34 is thus held in contact against the shoulder face 36 of strand 14.

Finally, back plate 34 includes opposite lateral walls 70, which extend downwards from the bottom support face. Lateral walls 70 frame transversely the front end 22 of strand 14, adjacent to the lateral surfaces 42 of front end 22. Lateral walls 70 are also adjacent to a top portion of lateral walls 52 of opening 46 so as to immobi1ize back plate transversely in relation to plate 32.

Thus, lug 64, lateral walls 70 and projecting portion 68 immobilize back plate 34 horizontally in all directions in relation to plate 32.

Plate 32 is made here of a metallic such as steel, whereas back plate 34 is made of a plastic material.

Of course, according to variants (not shown), plate 332 and back plate 34 could be made of other materials. They could also both be made of the same material.

Advantageously, the front transverse vertical face 72 of casing 24 which is opposite to the case of watch 10 is shaped such that it matches the shape of the case of watch 10.

Back plate 34 is secured here to plate 32 by the resilient snap fit of complementary shapes. Thus, orifices 74, two in number here, are reserved in the top contact surface 60 of plate 32. Hooks 76 that can deform resiliently in flexion extend vertically downwards from the bottom contact surface 62 of back plate 34 coinciding with orifices 74 of plate 32.

As shown in FIG. 4, hooks 76 are resiliently fitted into orifices 74 so as to secure back plate 34 to plate 32 pressing contact surfaces 60, 62 against each other and pinching the front end 22 of strand 14.

Figure 3B:
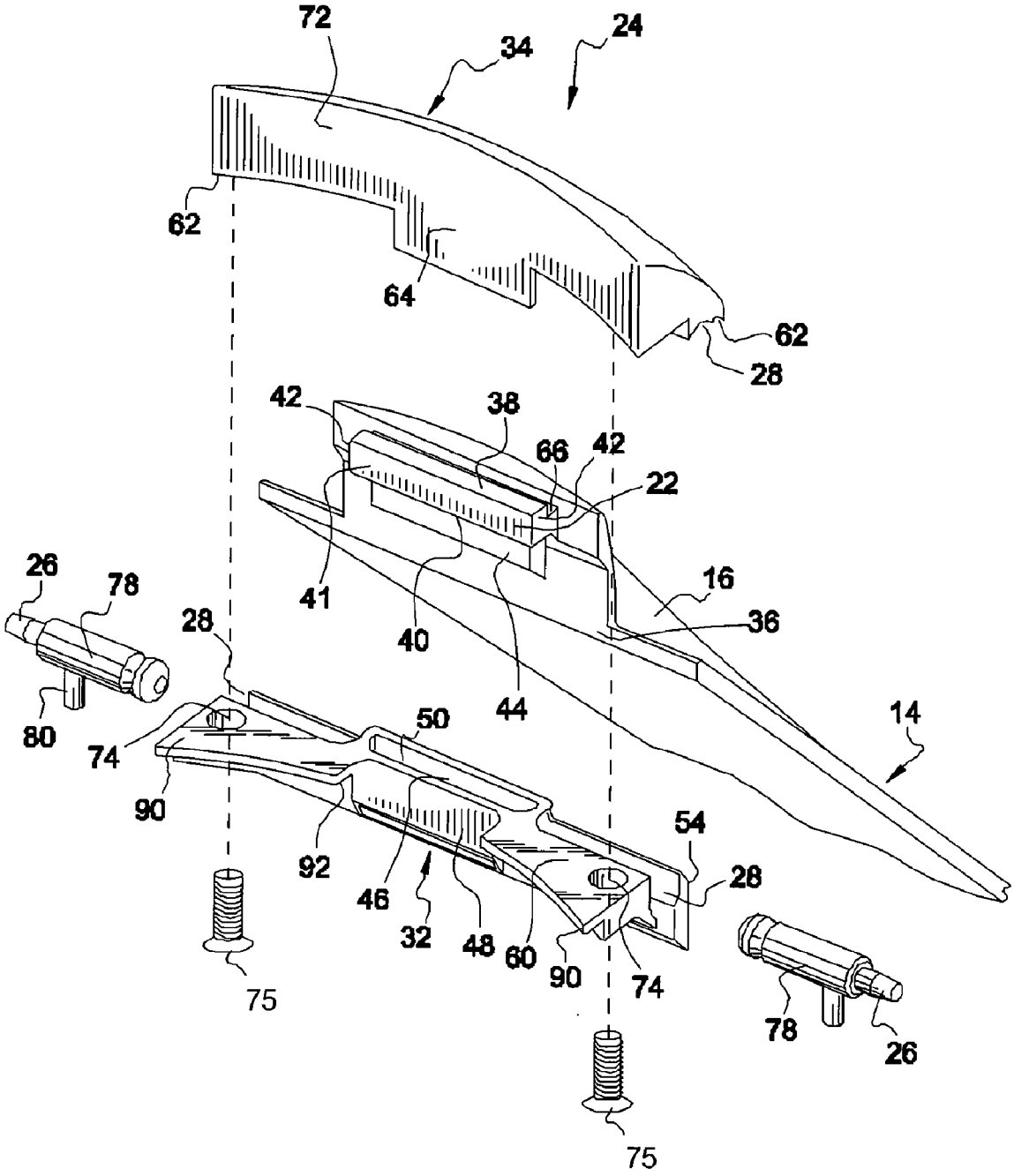
FIG. 3B is an exploded perspective view showing a link element having a back plate secured to the plate by screws.
Figure 3C:
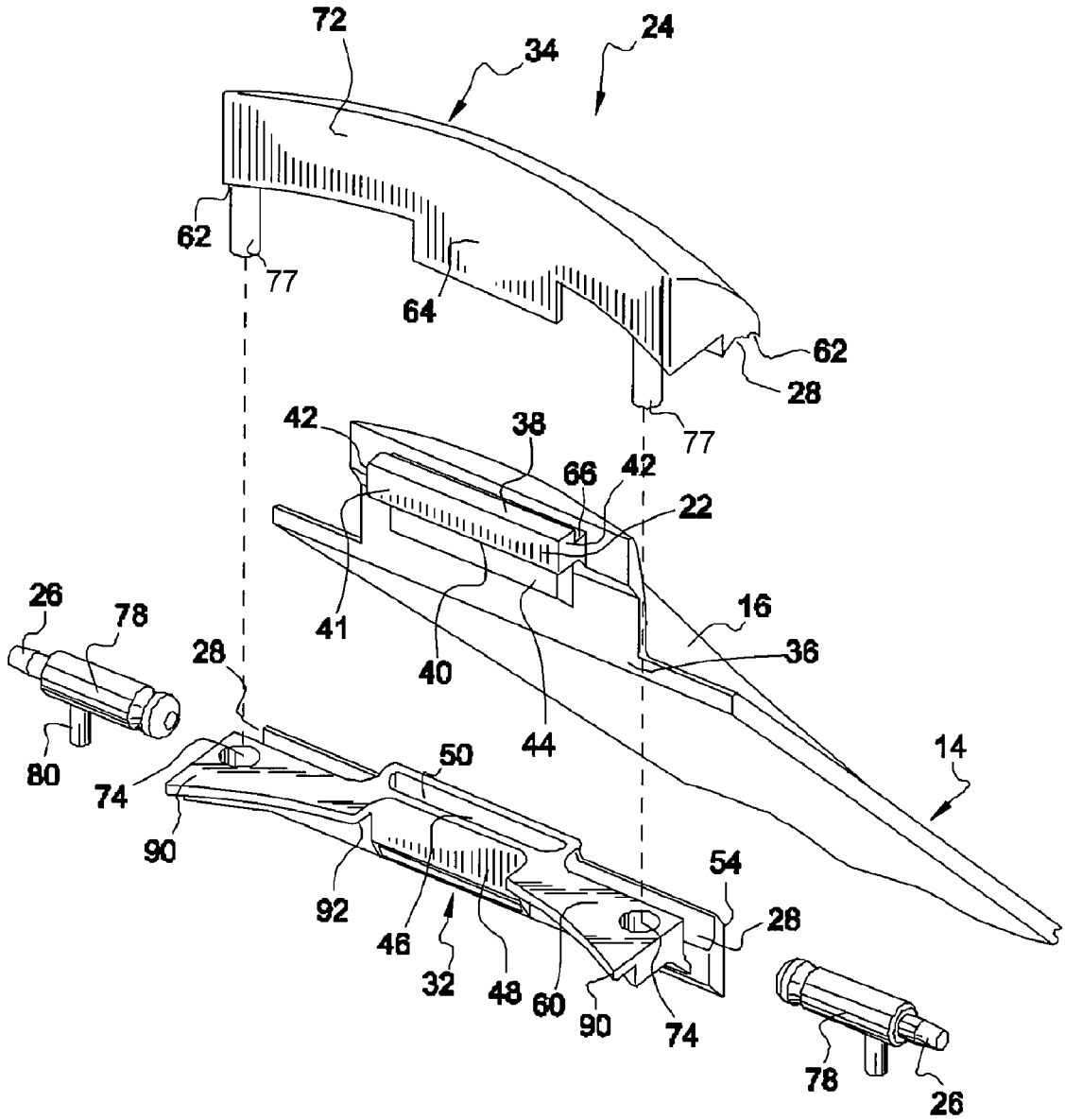
FIG. 3C is an exploded perspective view showing a link element having a back plate secured to the plate by bonding.

According to variants of the invention, back plate 34 can be secured to plate 32 by other means, particularly by bonding contact surfaces 60, 62 to each other (as shown in FIG. 3C), or by screws 75 (FIG. 3B. In the case of bonding, hooks 76 could be replaced by guide pins 77 to facilitate assembly.

According to another aspect of the invention, each lateral housing 28 of casing 24 is formed in part downwards in the top contact surface 60 of plate 32 and in part upwards in the bottom contact surface 62 of back plate 34.

As illustrated in FIG. 5, lateral housings 28 are arranged transversely on either side of front end 22 of strand 14.

Advantageously, each pin 26 is telescopically mounted axially in an associated socket 78 between a first external mounting position into which pin 26 is resiliently returned and in which the free end of pin 26 projects outside socket 78, and a second disassembling position in which the free end of pin 26 is retracted inside socket 78.

Each pin 26 includes here sliding control means in relation to socket 78. Pin 26 includes more specifically a control finger 80 which extends radially in relation to the transverse axis "A" of pin 26, more particularly vertically downwards. Control finger 80 extends outside socket 78 passing through a hole 82 provided for this purpose in the cylindrical wall of socket 78. Hole 82 has an oblong shape to enable control finger 80 to slide axially.

Each pin 26 and associated socket 78 are inserted transversely in the associated lateral housing 28 of casing 24.

In order to immobilise socket 79 along transverse axis "A", casing 24 includes two raised portions 84 each of which extends radially into each housing 28. Each raised portion 84 is received radially in an annular radial groove 86 of socket 78 by resilient deformation.

Annular groove 86 is arranged in proximity to an inner end of socket 78, which is distal from the associated lateral part of casing 24.

In a non-limiting manner, raised portion 84 is here carried by back plate 34. The manufacture of raised portion 84 inside lateral housing 28 is advantageously simplified by the fact that casing 24 is made in two parts. Raised portions 84 are thus advantageously made integral with back plate 34 for example by moulding.

When pins 26 are mounted in casing 24, control fingers 80 are received in two associated holes 88 of casing 24, as illustrated in FIGS. 3 and 4.

Each hole 88 passes through bottom plate 32 radially in relation to the transverse axis "A" to open into a cylindrical wall of one of lateral housings 28. Advantageously, as holes 88 are made in bottom plate 32, control fingers 80 extend under strand 14 so that they are not visible when watch 10 is worn by a user.

In order to allow the associated pin 26 to be mounted in casing 24, hole 88 is open transversely in one lateral wall of casing 24.

According to a variant of the invention that is not shown, pins 26 are received in a common socket. The two lateral housings 28 of casing 24 are then contiguous so as to form a single housing opening into the two opposite lateral walls of casing 24. This single housing is then shifted longitudinally forwards in relation to front end 22 of strand 14.

According to yet another aspect of the invention, bottom plate 32 includes a lower edge 90 which extends horizontally forwards. The front end edge of edge 90 is profiled so that it matches the contour of the case of watch 10 located opposite. Edge 90 will come into contact with the case of watch 10 so as to limit the pivoting of front end 22 of link element 12 in relation to watch 10 at least in the anti-clockwise direction with reference to FIGS. 3 and 4.

Edge 90 includes here a central recess 92, which enables a front end tongue 94 of top envelope 18 to pass through, as shown in FIG. 2. This front tongue 94 will be folded under strand 14 passing through recess 92 in order to fix top envelope 18 securely and discreetly underneath strand 14.

The rear bottom of recess 92 is formed here by front wall 48 of opening 46 of plate 32. The transverse width of recess 92 is equal to that of lug 64 of back plate 34. When back plate 34 is mounted on plate 32, front lug 64 of back plate 34 is thus guided by sliding vertically in relation to plate 32 via the lateral edges of recess 92.

The operation of assembling link element 12 will now be described.

Back plate 34 is arranged at a distance above plate 32 whereas pin 44 of front end 22 of strand 14 is vertically fitted downwards into opening 46 of plate 32. Then, back plate 34 is vertically descended against plate 32 such that lug 64 of back plate 34 penetrates recess 92 of plate 32.

Hooks 76 of back plate 34 are then inserted into the associated orifices 74 of plate 32 in order to secure back plate 34 and plate 32 to each other by resilient snap fitting, trapping the front end 22 of strand 14.

Sockets 78 carrying pins 26 are then inserted transversely into the associated lateral housing 28. When sockets 78 are inserted, raised portions 84 of housings 28 are resiliently deformed so as to be inserted in the associated annular groove 86 of socket 78. Sockets 78 are thus immobilized axially in casing 24.

Then, top envelope 18 is deposited on the top surface of strand 14, also covering back plate 34 of casing 24. One front end section of top envelope 19 is folded against the front face of casing 24, then front tongue 94 of top envelope 18 is pressed under the bottom surface of strand 14 under which it is secured, for example by bonding or sewing.

Bottom envelope 20 can then be secured under the bottom surface of strand 14, concealing front tongue 94 of top envelope 18.

The invention thus enables casing 24 to be mounted on strand 14 in a reduced number of operations which are very simple to implement.

What is claimed is:

1. A link element including one strand which extends longitudinally in a horizontal plane and one front end of which includes a device for attachment to a watch, the attachment device including:

a casing which is secured to the front end of the strand;

two coaxial securing pins of transverse axis which are received in two associated lateral housings of the casing, a free end of each pin being pivotally received about the transverse axis in one of the two opposite orifices of the watch, wherein the casing includes a bottom plate and a top back plate, and wherein the front end of the strand includes a holding pin, which is fitted vertically into an opening of the bottom plate, the top back plate being secured to the bottom plate trapping the front end of the strand such that the casing is secured to the strand.

2. The link element according to claim 1, wherein the top back plate is secured to the bottom plate by the resilient snap fit of complementary shapes.

3. The link element according to claim 1, wherein the top back plate is secured to the bottom plate by bonding.

4. The link element according to claim 1, wherein the top back plate is secured to the bottom plate by screws.

5. The link element according to claim 1, wherein the bottom plate includes first nested fitting means which cooperate with second complementary nested fitting means carried by the top back plate in order to block any horizontal movement of the bottom plate in relation to the top back plate.

6. The link element according to claim 1, wherein the bottom plate includes a top contact surface in direct contact with a bottom contact surface of the top back plate, and wherein each lateral housing of the casing is formed by two opposite recesses formed in the top and bottom contact surfaces respectively.

7. The link element according to claim 6, wherein each pin is telescopically mounted axially in an associated socket, and wherein each socket includes resilient snap fitting means inside the associated lateral housing of the casing.

8. The link element according to claim 7, wherein each lateral housing of the casing includes a raised portion which is received radially in an annular radial groove of the socket so as to immobilize the socket axially.

9. The link element according to claim 1, wherein the lateral housings are contiguous and wherein each pin is telescopically mounted axially in an end section of a single socket.

10. The link element according to claim 1, wherein the bottom plate includes a bottom edge which extends horizontally forwards in order to match the contour of the watch to limit the pivoting of the front end of the link element in relation to the watch.

11. The link element according to claim 1, wherein the strand is a flexible core which is made in a single piece.

12. The link element according to claim 11, wherein the strand is covered with a top envelope which extends above the top back plate of the casing.

13. The link element according to claim 12, wherein the bottom plate includes a bottom edge which extends horizontally forwards in order to match the contour of the watch to limit the pivoting of the front end of the link element in relation to the watch and wherein a front end section of the top envelope is folded downwards so as to extend at least as far as the bottom edge of the bottom plate.

14. The link element according to claim 13, wherein the bottom edge includes a recess which enables a front end tongue of the top envelope to be folded down in order to be secured under the bottom face of the strand.

15. The link element according to claim 12, wherein the envelope is made of leather.

16. The link element according to claim 12, wherein the envelope is made of a natural or synthetic fabric.

* * * * *